US005816168A

United States Patent [19]

Poissant

[11] Patent Number: 5,816,168

[45] Date of Patent: Oct. 6, 1998

[54] TRACK CLEANING DEVICE FOR MODEL RAILROAD CARS

[76] Inventor: Matthew N. Poissant, 537 Hallmark Dr., Newport News, Va. 23606

[21] Appl. No.: 799,624

[22] Filed: Feb. 12, 1997

[51] Int. Cl.[6] ..... B61F 19/00

[52] U.S. Cl. ..... 104/279; 105/238.2; 15/55

[58] Field of Search ..... 104/279, DIG. 1; 105/238.2; 15/55

[56] References Cited

U.S. PATENT DOCUMENTS

| | | | |
|---|---|---|---|
| 3,789,768 | 2/1974 | Broz | 104/279 |
| 4,741,027 | 4/1988 | Wilkerson | 15/55 |
| 5,437,233 | 8/1995 | Richter | 104/279 |

FOREIGN PATENT DOCUMENTS

| | | | |
|---|---|---|---|
| 1266195 | 4/1968 | Germany | 104/279 |
| 1934226 | 1/1971 | Germany | 104/279 |

*Primary Examiner*—S. Joseph Morano

[57] ABSTRACT

This track cleaning device is for model railroading enthusiasts that can be easily installed into many different types of model railroad cars. The track cleaning device car will provide an efficient method of keeping the electrical rails clean of foreign substances. The purpose of this car is to eliminate the manual operation of cleaning the rails.

5 Claims, 3 Drawing Sheets

TRACK CLEANING DEVICE FOR MODEL RAILROAD CARS

BACKGROUND OF THE INVENTION

1. The track cleaning device improves the application of currently cleaning the track with a pad, sand paper, or a roller. Usually, it takes alot of time to clean the rails manually using your hands. It is also very difficult not to damage the rails. On this invention the rotating brushes will act as a street sweeper to clean any debris, or foreign substance from the top surface of the rails by just pulling the car along with an engine.

2. Prior Art by Broz, Richter, German patent no. 1266195, and German patent no. 7934226, are examples of art of a toy track cleaning vehicles. Also, Kenneth R. Wilkerson, U.S. Pat. No. 4,741,072 is an example of prior art

SUMMARY OF THE INVENTION

The track cleaning device can be installed into many types of cars and almost every scale in model railroading. The rotating brushes will clean the top surface of the rail for improved electrical contact which will provide constant electrical contact to the electrical motors in the engines. The advantages of the track cleaning device are as follows:

it will eliminate the manual cleaning of the rails;

it will eliminate clogging of any pads currently used;

it will provide an easy operation to clean the track;

it will not damage the rails;

it will save time.

Although the description above contains many specifications, these should not be construed as limiting the scope of this track cleaning device. Thus the scope of this track cleaning device should be determined by the appended claims, rather than the examples given.

DESCRIPTION OF THE PREFERRED EMBODIMENT

Figure 1:
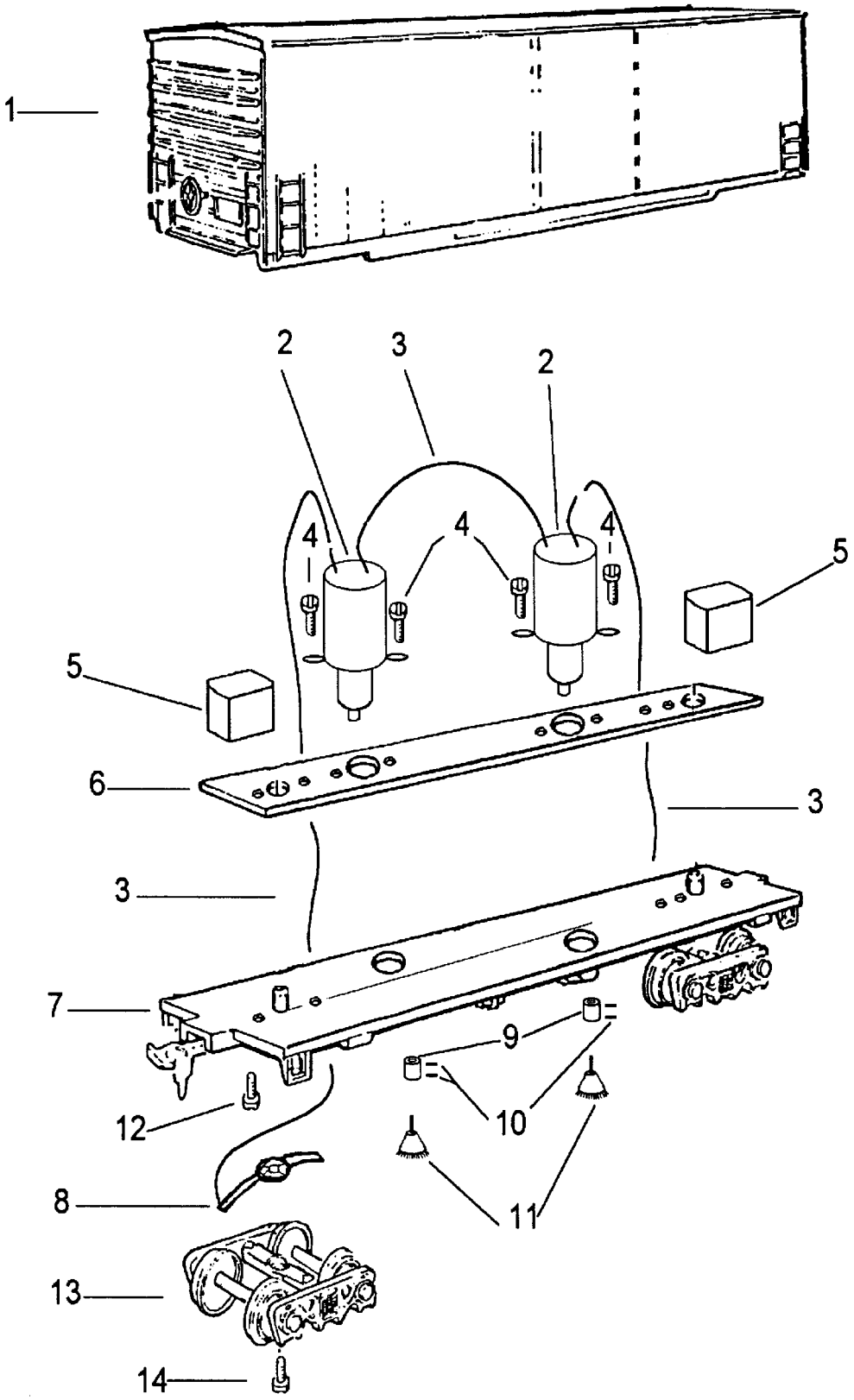
FIG. 1 illustrates the components of the track cleaning device installed into a box car.
Figure 2:
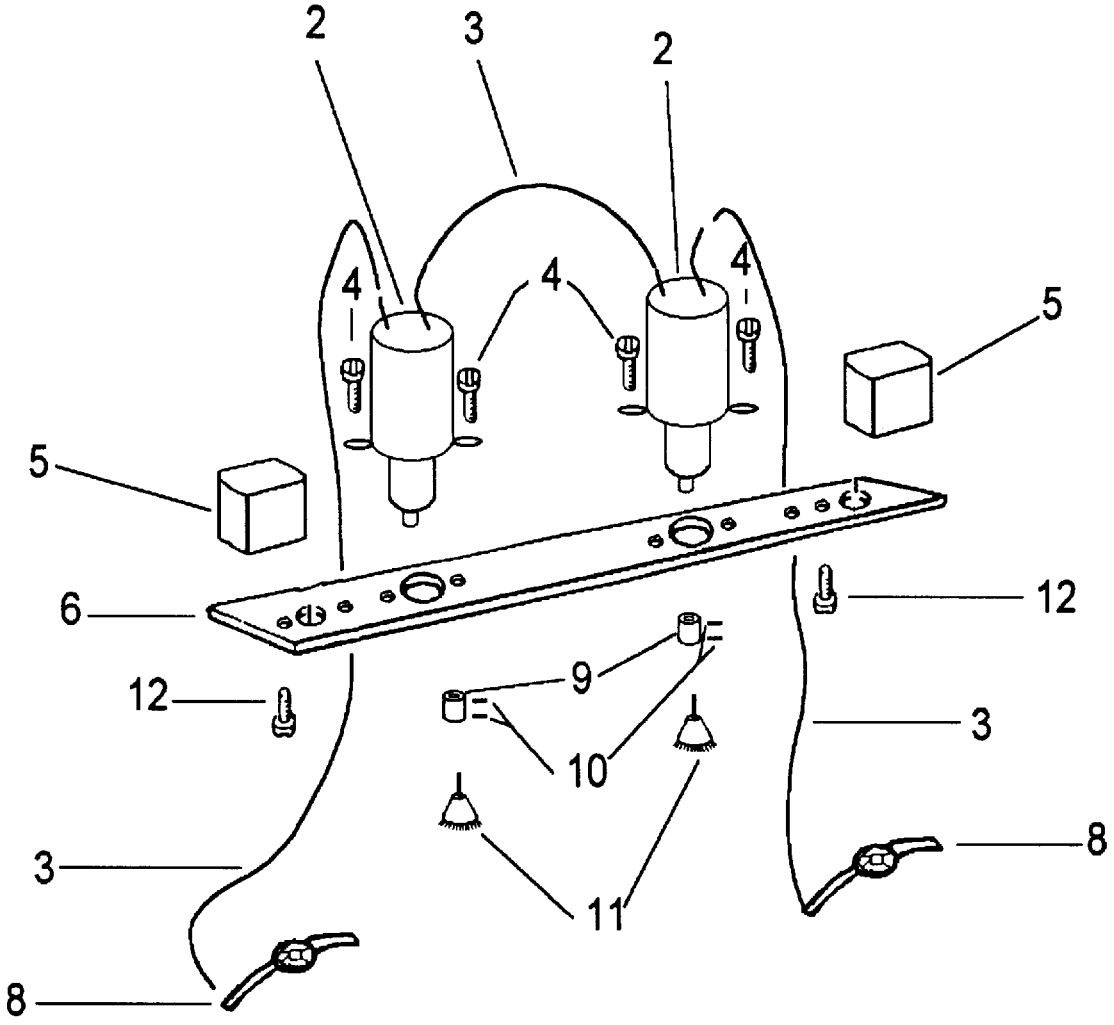
FIG. 2 illustrates the components needed for any model railroading car.
Figure 3:
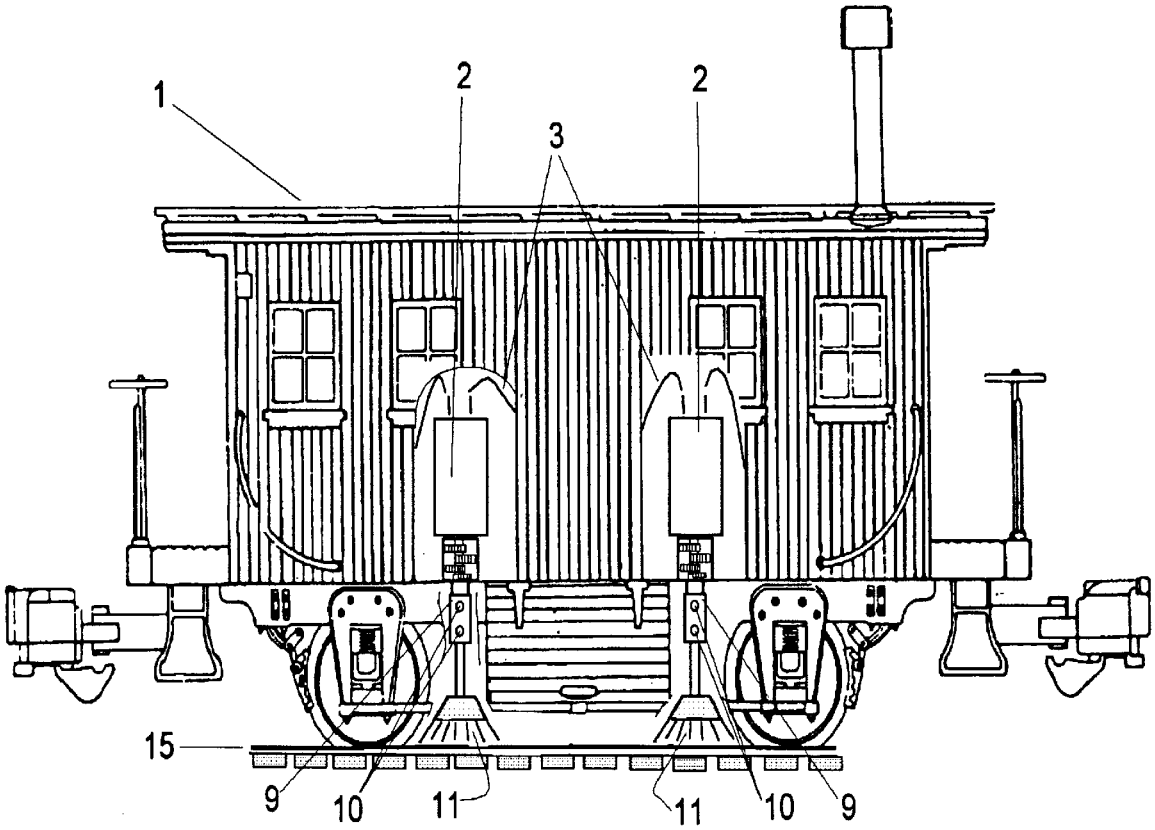
FIG. 3 illustrates the components installed into a caboose located on a model railroad track.

The track cleaning device comprises of simple parts which can be installed into most railroad cars in model railroading. These parts will be assembled in the following manner:

FIG. 1, illustrates a body 1 of a box car. This serves as a cover for the inner works of the track cleaning device. The metal wheels in the truck 13 will touch each contact 8 shown in FIG. 1 and FIG. 2. The electrical current will then run thru the electrical wires 3 to each electrical motor 2. The two electrical motors 2 will be supported by 2 mounting screws 4 and fastened to the mount 6 which will be the base of the assembly. Weights 5 will be located at each end of the mount 6. The support screws 12 will run thru the underframe 7, mount 6, and attached to each weight 5 which will hold the base and underframe together. The underframe 7 will hold the trucks 13 in-line to the rails 15 by each truck center screw 14. The couplers 9 will adjoin the electrical motors 2 and cleaning brushes 11 together. The electrical motors 2 and cleaning brushes 11 will be held together by each set screw 10 with the couplers 9. A side view in FIG. 3 shows the track cleaning device as it would operate in an actual model railroad car on a model railroad track.

The operation of the track cleaning device is as follows: Electrical current usually Direct Current (DC) will be needed to run this car. DC current runs thru each rail in model railroading from a power supply (not shown). The electrical current will travel thru the metal wheels on the truck 13. The electricity then will be picked up by each contact 12 shown in FIG. 2. Each contact 12 will only pick up a positive or negative charge from the DC power supply. Each electrical motors 2 will be held in place by two mounting screws 4 which will be fastened to the mount 6. The electrical power will run each electrical motor 2 which will rotate and transmit a rotational torque thru the couplers 9 to rotate the cleaning brushes 11. Each cleaning brush 11 will be held in place by a set screw 10. The support screw 12 will hold together the underframe 7 and mount 6 together which will hold the electrical motors 2 in place. While rotating, the cleaning brushes 11 will contact the top of each rail 15 to clean of the top surface of the rail 15 for improved electrical contact. While the cleaning brushes 11 are rotating, an upward reaction force from these cleaning brushes 11 will be offset by the weights 5 which will be a downward force to hold the track cleaning car on the rails 15. FIG. 3 shows a side view of a track cleaning car. The body 1 is a caboose. Shown are the cleaning brushes 11 contacting the top surface of each rail 15.

I claim:

1. A track cleaning device for a model railroad car comprising:

a mount for attachment to the car, at least one electric motor on said mount, a cleaning brush attached to said motor by a coupler for enabling rotation of said brush relative to a track, an electrical contact on said mount and electrically connected with said at least one motor for supplying electricity from the track to said motor so as to power rotation of the brush attached thereto, and at least one weight attached to said mount at a location remote from said at least one motor for counteracting an upward reaction force due to the rotation of said brush.

2. A track cleaning device for a model railroad car according to claim 1, wherein said at least one motor comprises two motors with a respective said brush, coupler, and weight, associated with each said motor.

3. A track cleaning model railroad car comprising:

a railway car underframe including two trucks attached thereto for riding on rails of a model railroad track, and a mount for attachment of a cleaning device to the underframe, said cleaning device comprising, at least one electric motor on said mount, a cleaning brush attached to said motor by a coupler for enabling rotation of said brush relative to the rails, an electrical contact on said mount electrically connected with said at least one motor for supplying electricity from the track to said motor so as to power rotation of the brush attached thereto, and at least one weight attached to said mount at a location remote from said at least one motor for counteracting an upward reaction force due to the rotation of said brush.

4. A track cleaning model railroad car according to claim 3, wherein said at least one motor comprises two motors with a respective said brush, coupler, and weight, associated with each said motor.

5. A track cleaning model railroad car according to claim 3, further comprising a car body attached to said mount for enclosing at least a portion of said cleaning device.

* * * * *